United States Patent [19]

Fadner

[11] Patent Number: 4,601,242

[45] Date of Patent: Jul. 22, 1986

[54] COPPER AND CERAMIC COMPOSITE INK METERING ROLLER

[75] Inventor: Thomas A. Fadner, LaGrange, Ill.

[73] Assignee: Rockwell International Corporation, Pittsburgh, Pa.

[21] Appl. No.: 698,201

[22] Filed: Feb. 4, 1985

[51] Int. Cl.[4] ..... B41F 31/26

[52] U.S. Cl. ..... 101/348

[58] Field of Search ..... 101/348, 350, 363; 29/121.2, 132, DIG. 39; 427/34, 423, 427

[56] References Cited

U.S. PATENT DOCUMENTS

| | | | |
|---|---|---|---|
| 3,613,578 | 10/1971 | Heurich | 101/350 |
| 4,009,658 | 3/1977 | Heurich | 101/348 |
| 4,391,879 | 7/1983 | Fabian | 29/132 |

FOREIGN PATENT DOCUMENTS

| | | | |
|---|---|---|---|
| 3139646 | 7/1982 | Fed. Rep. of Germany | 101/348 |
| 3220534 | 12/1983 | Fed. Rep. of Germany | 101/348 |
| 0056855 | 4/1983 | Japan | 101/348 |
| 1585143 | 2/1981 | United Kingdom | 101/348 |

*Primary Examiner*—J. Reed Fisher

[57] ABSTRACT

An ink metering roller comprised of a base roller, a substantially continuous layer of oleophilic/hydrophobic material bonded on the outer surface of the base roller and a continuous outer microporous ceramic layer bonded to the oleophilic/hydrophobic layer, the ceramic layer forming the outermost layer of the base roller.

9 Claims, 6 Drawing Figures

COPPER AND CERAMIC COMPOSITE INK METERING ROLLER

BACKGROUND OF THE INVENTION

In the practice of conventional lithographic printing, it is essential to maintain sufficient water in the non-image areas of the printing plate to assure that image/-non-image differentiation is maintained, that is, to assure that ink will transfer only to the image portions of the printing plate format. Many different dampening or water conveying systems have been devised and these systems can be referred to by consulting "An Engineering Analysis of the Lithographic Printing Process" published by J. MacPhee in the Graphic Arts Monthly, November, 1979, pages 666–68, 672–73. Neither the nature of the dampening system nor the nature of the dampening materials that are routinely used in the practice of high speed lithography are expected to place restrictions on the utilizing the teachings conveyed in this disclosure.

The dampening water in lithography is commonly supplied to the printing plate in the form of a dilute aqueous solution containing various proprietary combinations of buffering salts, gums, wetting agents, alcohols, fungicides and the like, which additives function to assist in the practical and efficient utilization of the various water supply and dampening systems combinations that are available for the practice of lithographic printing. Despite their very low concentrations, typically less than about one percent, the salts and wetting agents have been found in practice to be essential if the printing press system is to produce printed copies having clean, tint-free background and sharp, clean images, without having to pay undue and impractical amounts of attention to inking and dampening system controls during operation of the press. Apparently the dampening solution additives help to keep the printing plate non-image areas free of spurious specks or dots of ink that may be forced into those areas during printing.

It is well known in the art and practice of lithographic printing that ink is relatively easily lifted off, cleaned off, or debonded from most metallic surfaces, from most metal oxide surfaces and from virtually all high surface energy materials, such as the non-image areas of lithographic printing plates, by the action or in the presence of typical lithographic dampening solutions used in the printing industry. A similar phenomenon may occur when ordinary water or deionized water or distilled water is used without the dampening additives, but the debonding action of the water will generally be less efficient and will take place more slowly. In fact, lithographers have found that it is virtually impossible to produce acceptable lithographic printing quality efficiently or reproducibly using dampening water not containing the kinds of additives previously referred to.

Reference to R. W. Bassemir or to T. A. Fadner in "Colloids and Surfaces in Reprographic Technology", published by the American Chemical Society in 1982 as ACS Symposium Series 200, will relate that in the art of lithography the inks must be able to assimilate or take up a quantity of water for the lithographic process to have practical operational latitude. Apparently the ink acts as a reservoir for spurious quantities of water that may appear in inked images areas of the plate, since water is continuously being forced onto and into the ink in the pressure areas formed at the nip junction of ink rollers, dampening system rollers, and printing plates of the printing press. Whatever the mechanism might be, all successful lithographic inks when sampled from the inking system rollers are found to contain from about one percent to about as high as 40 percent of water, more or less, within and after a few revolutions to several thousand revolutions after start-up of the printing press. During operation of the press, some of the inking rollers must unavoidably encounter surfaces containing water, such as the printing plate, from which contact a more or less gradual build up of water in the ink takes place, proceeding eventually back through the inking train, often all the way to the ink reservoir. Consequently, the presence of water in the ink during lithographic printing is a common expected occurrence.

An important concept in this invention is recognition that all rollers of the purposefully foreshortened inking train of rollers in simplified ink systems must be either unreactive with water or not adversely affected by water or more precisely by lithographic dampening solutions which may have been transferred to the ink or that may otherwise be encountered by the inking rollers during routine operation of the printing press. If water can react or interact to displace the ink from any part of the inking rollers' surfaces, the transport or transfer of ink to the printing plate, thence to the substrate being printed, will be interrupted in that area, resulting in a more or less severe disruption in printed ink density and/or hue over some or all portions of the intended image areas and a concomitant loss of inking control. This invention provides means and material for avoiding that catastrophe.

In lithographic printing press inking roller train systems, it is typically advantageous to select materials such that every other roller of the inking train participating in the film splitting and ink transfer is made from relatively soft, rubber-like, elastically compressible materials such as natural rubber, polyurethanes, Buna N and the like, materials that are known to have a natural affinity for ink and a preference for ink over water in the lithographic ink/water environment. The remaining rollers are made usually of a comparatively harder metallic material or occasionally a comparatively harder plastic or thermoplastic material such as mineral-filled nylons or hard rubber. This combination of alternating hard or incompressible and soft or compressible rollers is a standard practice in the art of printing press manufacture. It is important to note, although it has not yet been explained, that the only practical and suitable metallic material the printing industry has found for use as the hard roller surface in lithographic inking systems is copper. Consequently, in the art of lithography, all metallic rollers for the inking system that will be subjected to relatively high dampening water concentration, namely those nearest the dampening system components and those nearest the printing plate, must and do have copper surface. Copper had been found long ago to possess consistent preference for ink in the presence of dampening water, unless it is inadvertently adversely contaminated. Means for cleaning or resensitizing contaminated copper surfaces towards ink are well known in the art of lithography. When any other practical hard metal surface such as iron, steel, chrome, or nickel is used in the place of copper, debonding of ink from the roller surface by dampening water may sooner or later occur, with its attendant severely adverse printed quality and process control problems. It is known that the relative propensity for debonding of ink from a surface depends in part, at least, upon the amount of water in the ink. Lithographic press manufacturers have found, for instance, that although ink can readily be debonded from hardened steel in the presence of modest to large amounts of water, small amounts of water in the ink, for example less than a few percent, generally may not cause debonding. Consequently, rollers near or at the incoming reservoir of fresh ink, that is near the beginning of typical multi-roller inking trains and therefore relatively far from the sources of water may be successfully used when manufactured from various hard, non-copper metals such as iron and its various appropriate steel alloys. The balance of the relatively hard rollers are commonly made using copper for the reasons just stated.

Although there has been speculation about the reasons for the advantageous properties of copper for use in inking rollers, it remains uncertain why copper tends to prefer ink over water. For the convenience of this disclosure, this property will be referred to as oleophilic meaning ink or oil loving and hydrophobic or water shedding. As indicated in this disclosure, certain of the rubber and plastic roller materials may be useful as the hard rollers in conventional, long train inkers. These, too, have the oleophilic/hydrophobic oil/water preference property, though perhaps for different scientific reasons than with copper.

In the case of metallic or polymeric rubber or plastic rollers, whether soft or hard, this oleophilic/hydrophobic behavior can be more or less predicted by measuring the degree to which droplets of ink oil and of dampening water will spontaneously spread out on the surface of the metal or polymer rubber or plastic. The sessile drop technique as described in standard surface chemistry textbooks is suitable for measuring this quality. Generally, oleophilic/hydrophobic roller materials will have an ink oil (Flint Ink Co.) contact angle of nearly 0° and a distilled water contact angle of about 90° or higher and these values serve to define an oleophilic/hydrophobic material.

I have found, for instance, that the following rules are constructive in but not restrictive for selecting materials according to this principle:

| | |
|---|---|
| Best | Water contact angle 90° or higher.<br>Ink Oil contact angle 10° or lower and spreading. |
| Maybe Acceptable | Water contact angle 80° or higher.<br>Ink Oil contact angle 10° or lower and spreading. |
| Probably Not Acceptable | Water contact angle less than about 80°.<br>Ink Oil contact angle greater than 10° and/or non-spreading. |

Another related test is to place a thin film of ink on the material being tested, then place a droplet of dampening solution on the ink film. The longer it takes and the lesser extent to which the water solution displaces or debonds the ink, the greater is that materials' oleophilic/hydrophobic property.

Materials that have this oleophilic/hydrophobic property as defined herein will in practice in a lithographic printing press configuration accept, retain and maintain lithographic ink on its surface in preference to water or dampening solution when both ink and water are presented to or forced onto that surface. And it is this oleophilic/hydrophobic property that allows rollers used in lithographic press inking roller trains to transport ink from an ink reservoir to the substrate being printed without loss of printed-ink density control due to debonding of the ink by water from one or more of the inking rollers.

REFERENCES TO THE PRIOR ART

Warner in U.S. Pat. No. 4,287,827 describes a novel inking roller that is manufactured to have bimetal surfaces, for instance chromium and copper, which different roller surfaces are claimed to simultaneously carry dampening solution and ink, respectively, to the form rollers of a simplified inking system. The Warner technology specifies planarity of the roller surface which is a distinct departure from the instant invention. In the Warner technology, the ink-loving copper areas will carry an ink quantity corresponding to the thickness of the ink film being conveyed to it by preceding rollers in the inking system. Thus the primary metering of the ink is done separately from the bimetallic-surfaced roller or through the use of a flooded nip between the bimetal roller and a coacting resiliantly-covered inking roller. This contrasts completely with the instant technology, in which one utilizes a celled ink-loving roller which together with a doctor blade defines the amount of ink being conveyed to the form rollers and is therefore truly an ink-metering roller. In addition, the instant invention involves using an independent dampening system, rather than relying on hydrophilic land areas of the inking roller as in the Warner technology to supply dampening solution to the printing plate.

A number of celled or recessed or anilox-type ink metering rollers have been described in trade and technical literature. The American Newspaper Publishers Association (ANPA) has described in Matalia and Navi U.S. Pat. No. 4,407,196 a simplified inking system for letterpress printing, which uses chromium or hardened steel or hard ceramic materials like tungsten carbide and aluminum oxide as the metering roller material of construction. These hard materials are advantageously used to minimize roller wear in a celled ink-metering roller inking system operating with a continuously-scraping coextensive doctoring blade. Letterpress printing does not require purposeful and continuous addition of water to the printing system for image differentiation and therefore debonding of ink from these inherently hydrophilic rollers by water does not occur and continuous ink metering control is possible. Attempts have been made to adopt the ANPA system to lithographic printing without benefit of the instant technology. The ANPA technology rollers are naturally both oleophilic and hydrophilic and will sooner or later fail by water debonding ink from the metering roller. The failure will be particularly evident at high printing speeds where build-up of water occurs more rapidly and for combinations of printing formats and ink formulations that have high water demand. The instant technology avoids these sensitivities.

Granger in U.S. Pat. No. 3,587,463 discloses the use of a single celled inking roller, which operates in a mechanical sense, substantially like the inking system schematically illustrated in this disclosure as FIGS. 1 and 2, excepting that no provision for dampening, therefore for lithographic printing was disclosed nor anticipated. Granger's system will not function in lithographic printing for reasons similar to that already presented in the Matalia and Navi case.

Fadner and Hycner in copending application Ser. No. 649,773, filed Sept. 12, 1984, and assigned to the same assignee as the present invention disclose an improved ink metering roller in which disclosure an inking roller and process for producing the roll in which the black-oxide of iron is utilized to accomplish superior results.

SUMMARY OF THE INVENTION

This invention relates to method, materials and apparatus for metering ink in modern, high-speed lithographic printing press systems, wherein means are provided to simplify the inking system and to simplify the degree of operator control or attention required during operation of the printing press.

The amount of ink reaching the printing plate is controlled primarily by the dimensions of depressions or cells in the surface of a metering roller and by a coextensive scraping or doctor blade that continuously removes virtually all the ink from the celled metering roller except that carried in the cells or recesses.

The ink metering roller is composed of a steel core of suitable length and diameter, engraved or otherwise manufactured to have accurately-dimensioned and positioned cells or recesses in its face surface and lands or bearing regions which comprise all the rollers face surface excepting that occupied by cells, which cells together with a scraping doctor blade serve to precisely meter a required volume of ink. To assure economically acceptable metering roller lifetimes, without serious deviation of the metering roller's ink volume control function, the metering roller core is plated with a thin layer of copper then over coated with a thin, hard, wear resistant ceramic coating.

A primary objective of this invention is to provide a simple, inexpensive manufacturing method and roller made therefrom that insures the economically practical operation of a simple system for continuously conveying ink to the printing plate in lithographic printing press systems.

Another primary objective of this invention is to provide a roller with a celled metering surface that continuously measures and transfers the correct, predetermined quantity of ink to the printing plate and thereby to the substrate being printed, without having to rely on difficult-to-control slip-nips formed by contact of smooth inking rollers driven at different surface speeds from one another.

Another object of this invention is to provide a metering roller surface that is sufficiently hard and wear-resistant to allow long celled-roller lifetimes despite the scraping, wearing action of a doctor blade substantially in contact with it.

Still another objective of this invention is to provide automatic uniform metering of precisely controlled amounts of ink across the press width without necessity for operator interference as for instance in the setting of inking keys common to the current art of lithographic printing.

A further objective is to advantageously control the amount of detrimental starvation ghosting typical of simplified inking systems by continuously overfilling precisely-formed recesses or cells in a metering roller surface with ink during each revolution of said roller, then immediately and continuously scraping away all of the ink picked up by said roller, excepting that retained in said cells or recesses, thereby presenting the same precisely-metered amounts of ink to the printing plate form rollers each and every revolution of the printing press system.

Yet another object of this invention is to provide material and method for assuring that aqueous lithographic dampening solutions and their admixtures with lithographic inks do not interfere with the capability of a celled ink-metering roller to continuously and repeatedly pick-up and transfer precise quantities of ink.

A still further object of this invention is to provide an improved inking roll having a composite structure that combines high degrees of ink attraction and ink retention with a long wearing surface.

These and other objectives and characteristics of this invention will become apparent by referring to the following descriptions and drawings and disclosures.

DESCRIPTION OF DRAWINGS

Drawings of preferred and alternative embodiments of the invention are attached for better understanding of the elements discussed in this disclosure. These embodiments are presented for clarity and are not meant to be restrictive or limiting to the spirit or scope of the invention, as will become apparent in the body of the disclosure.

DESCRIPTION OF THE PREFERRED EMBODIMENT

Figure 1:
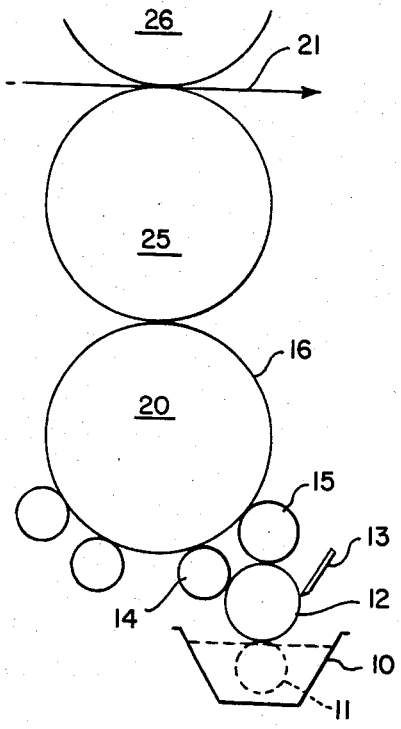
FIG. 1 is a schematic and elevation of one preferred application of the inking roll of this invention.
Figure 2:
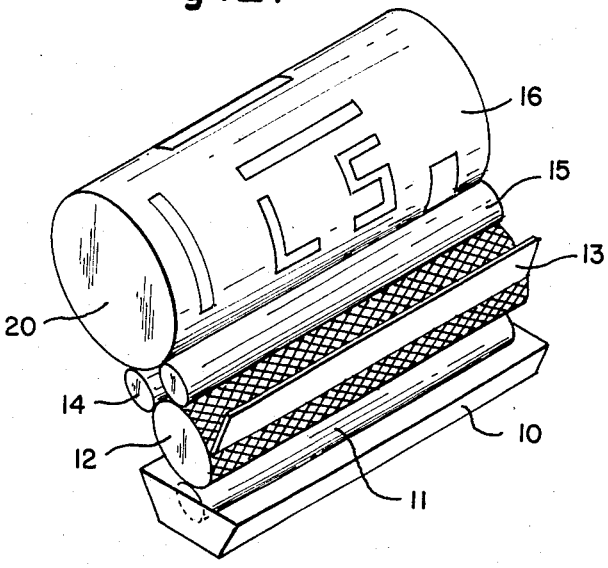
FIG. 2 is a perspective view of the combined elements of FIG. 1.
Figure 3:
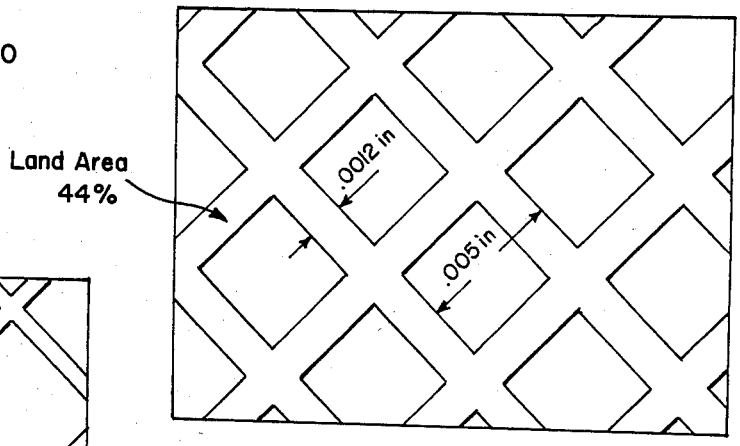
FIG. 3 is a schematic showing a cell pattern which may be used in this invention.
Figure 4:
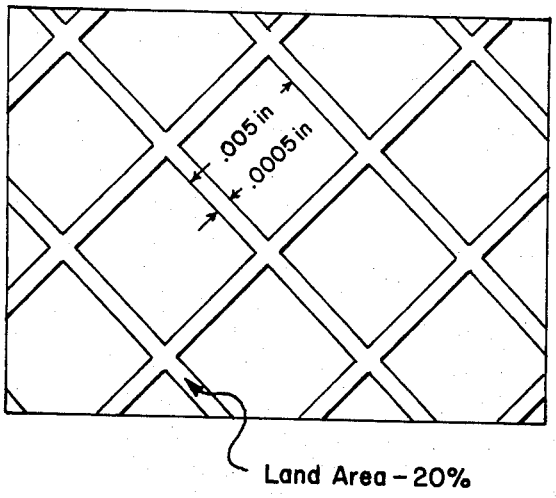
FIG. 4 is an alternative cell pattern.
Figure 5:
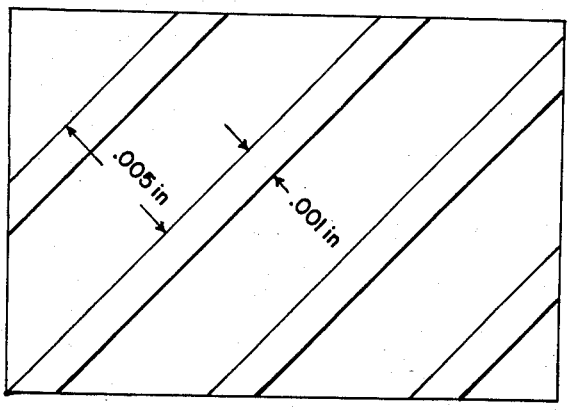
FIG. 5 is another alternative cell pattern that can be advantageously used with this invention.
Figure 6:
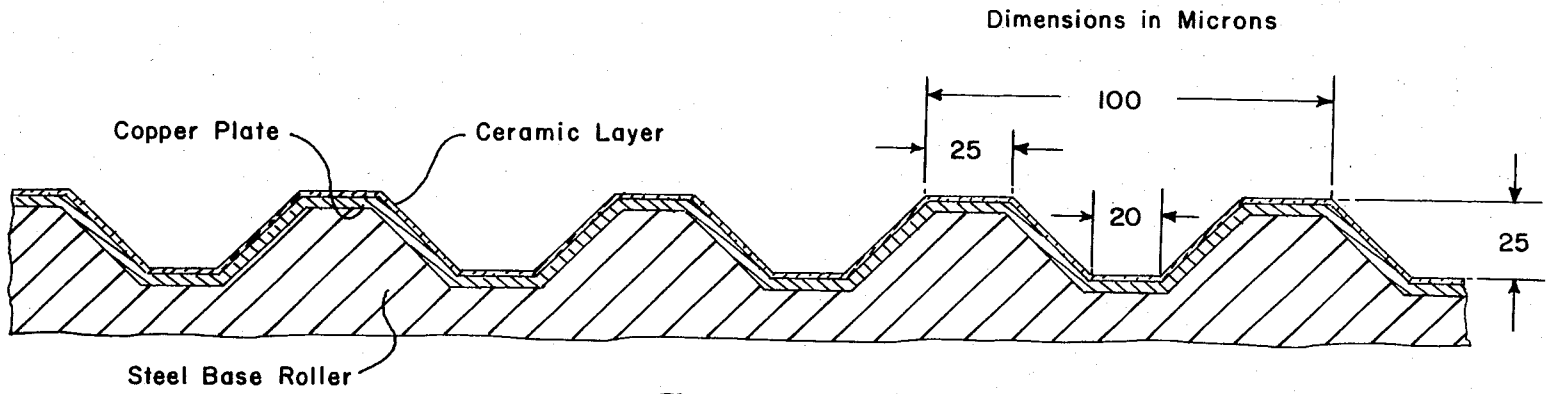
FIG. 6 is a schematic magnified view showing the celled roller having a copper and a ceramic layer.

Referring to FIGS. 1 and 2, an inker configuration suited to the practice of this invention in offset lithography consists of an ink-reservoir or ink-fountain 10 and/or a driven ink-fountain roller 11, a press-driven oleophilic/hydrophobic engraved or cellular roller 12, a reverse-angle metering blade or doctor-blade 13, and friction driven form rollers 14 and 15, which supply ink to a printing plate 16 mounted on plate-cylinder 20 and this in turn supplies ink to for example a paper web 21 being fed through the printing nip formed by the blanket cylinder 25 and the impression cylinder 26. All of the rollers in FIGS. 1 and 2 are configured substantially parallel axially.

The celled metering roller 12 of FIGS. 1, 2, 3, 4 and 5 is the novel element of this invention. It consists of mechanically engraved or otherwise-formed, patterned cells or depressions in the face surface of the roller, the volume and frequency of the depressions being selected based on the volume of ink needed to meet required printed optical density specifications. The nature of this special roller is made clear elsewhere in this disclosure and additionally in part, in FIGS. 3, 4 and 5 which depict suitable alternative patterns and cross-sections. Generally the celled metering roller will be rotated by a suitable driving mechanism at the same speed as the printing cylinders 20, 25 and 26 of FIG. 1, typically from about 500 to 2000 revolutions per minute.

The doctor blade 13 depicted schematically in FIG. 1 and in perspective in FIG. 2 is typically made of flexible spring steel about 6 to 10 mils thick, with a chamfered edge to better facilitate precise ink removal. Mounting of the blade relative to the special metering roller is critical to successful practice of this invention but does not constitute a claim herein since doctor blade mounting techniques suitable for the practice of this invention are well known. The doctor blade or the celled metering roller may be vibrated axially during operation to distribute the wear patterns and achieve additional ink film uniformity.

Typically, differently-diametered form-rollers 14 and 15 of FIG. 1 are preferred in inking systems to help reduce ghosting in the printed images. These rollers will generally be a resiliantly-covered composite of some kind, typically having a Shore A hardness value between about 22 and 28. The form rollers preferably are mutually independently adjustable to the printing plate cylinder 20 and to the special metering roller 12 of this invention, and pivotally mounted about the metering roller and fitted with manual or automatic trip-off mechanisms as is well known in the art of printing press design. The form rollers are typically and advantageously friction driven by the plate cylinder 20 and/or the metering roller 12.

I have found that hard, wear-resistant materials available for manufacture of an inking roller are naturally hydrophilic, rather than hydrophobic. And the commonly-used hard metals such as chromium or nickel and hardened iron alloys such as various grades of steel, as well as readily-available ceramic materials such as aluminum oxide and tungsten carbide prefer to have a layer of water rather than a layer of ink on their surfaces when both liquids are present. This preference is enhanced in situations where portions of the fresh material surfaces are continuously being exposed because of the gradual wearing action of a doctor blade. It is also enhanced if that fresh, chemically-reactive metal surface tends to form hydrophilic oxides in the presence of atmospheric oxygen and water from the lithographic dampening solution. Oxidizing corrosion to form iron oxide $Fe_2O_3$ in the case of steel compounds is a typical example. Thus, although various grades of steel, chromium and its oxides, nickel and its oxides will readily operate as the uppermost surface in an ink-metering roller for printing systems not requiring water, such as letterpress printing, these same surfaces will become debonded of ink when sufficient dampening water penetrates to the roller surface, as for instance, in the practice of lithographic printing. The action of a doctor blade on a rotating ink-metering roller more-or-less rapidly exposes fresh metering roller surface material which prefers water. This is more readily understood if one considers that hydrophilic, water-loving, surfaces are also oleophilic, oil-loving in the absence of water, such as when fresh, unused, water-free lithographic ink is applied to a steel or ceramic roller. Initially the ink exhibits good adhesion and wetting to the roller. During printing operations, as the water content in the ink increases, a point will be reached when a combination of roller nip pressures and increasing water content in the ink force water through the ink layer to the roller surface thereby debonding the ink from these naturally hydrophilic surfaces, the ink layer thereby becoming more-or-less permanently replaced by the more stable water layer.

I have discovered that these water-interference problems associated with using state-of-the-art ceramic-covered rollers to meter ink in simpified, lithographic, keyless inking systems can be avoided by first applying a copper coating to a mechanically-appropriate engraved roller, then overcoating the copper-covered roller with a thin, purposefully microporous layer of ceramic material. Contrary to expectation, flame-sprayed ceramic particles adhere well to the copper layer, resist rapid wear in contact with the ink-doctoring blade and, the resulting roller retains the required hydrophobic/oleophilic qualities during long-term use as an ink-metering roller in the practice of keyless lithography.

In the practice of this invention, a 0.2 to 0.3 mil copper layer may be electrolytically applied to a mechanically-engraved AISI 1018 or 1020 steel roller, then in a subsequent operation apply about 1 mil of ceramic layer. Alternately, the copper may be applied by well-known electroless coating techniques or by powder coating methods. Preferably the copper layer thickness is held to the minimum consistent with overall coverage of the roller. Apparently, the copper provides a hydrophobic/oleophilic anchor for ink that is forced through the porous ceramic layer during printing operations. Without this copper basecoating, water that is present in the ink would eventually displace the ink from the ceramic and steel surfaces, destroying the roller's metering capability.

The ceramic coating of this invention is advantageously applied by well-known flame-spraying techniques as particles of from about $0.5\times10^{-4}$ to $5\times10^{-4}$ inch in diameter, which particles fuse permanently to themselves and to the copper layer. Particles significantly smaller than the indicated values are difficult to flame-spray in a controlled manner and are expected to result in insufficient porosity of the deposited coating. Larger ceramic particles, such as about $10^{-3}$ inches in diameter or larger, tend to be insufficiently bonded and have a fretting or chipping response to scraping doctor-blade action, therefore, wear more rapidly than one might predict from the inherent hardness of the ceramic.

I have found that a nominal ceramic coating thickness of about one to two mils is advantageous when using the indicated ceramic bead dimensions. The tortuosity of the ceramic-coating pores serve in conjunction with the copper base coat to render virtually impossible ink displacement by spurious water that may be encountered during keyless lithographic printing.

Although I cannot verify that the preceding explanation accounts for the beneficial oleophilic/hydrophobic behavior of rollers manufactured according to the teachings of this disclosure, these explanations fit with the demonstrable fact that when oils react with metals such as copper they tend to form one or less permanent compounds that reside on the metal surface with their oil or hydrocarbon portions as the outermost surface. Hydrocarbon surfaces are well-documented in technical literature as low energy, oil-loving, water-rejecting chemical entities and as such would explain why debonding of ink from the roller of this invention may not occur when used on printing press configurations simultaneously subjected to both ink and to aqueous dampening solution such as in lithographic printing.

To illustrate the purposes and advantages of this invention, the following example is given:

1. A 36-inch face length, 4.42 inch diameter, AISI 1020 steel roller was mechanically engraved by Pamarco Inc., Roselle, N.J., using a standard 250 lines/inch, truncated-quandrangular engraving tool. Engraved-cell dimensions were 90 microns (3.6 mil) width at the surface, 43 microns (1.8 mil) at the base and 25 microns (1 mil) deep; land widths were 10 microns (0.4 mil). The engraved roller was then electrolytically coated by Pamarco with a calculated 0.2 to 0.3 micron layer of copper, using a standard cyanide-bath procedure. The copper-plated roller was then grit-blasted with 30 micron average-diameter aluminum oxide powder to roughen the surface and enhance subsequent adhesion. It was then plasma-sprayed to form a approximately 25 micron (1 mil) thick ceramic coating using 5 micron (0.2 mil) average diameter aluminum oxide ($Al_2O_3$) powder particles. Finally, the roller was lightly sanded to remove rough and poorly adhered $Al_2O_3$ particle residues from the uppermost surface. The roller was placed in position 12 of FIG. 1 and provided good printing properties as the ink-metering roller. The roller was similarly-tested after 10 million, 20 million, and 30 million printing impressions, giving satisfactory printed results in each case with no indications of failure to meter ink due to intervention of the water required during the lithographic printing tests.

Although the present invention has been described in connection with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. An ink metering roller for use in lithographic printing comprising:

(a) a base roller of suitable diameter and length having an engraved outer surface;

(b) a substantially continuous layer of an oleophilic/-hydrophobic material having a water contact angle of 80° or higher and an ink contact angle of 10° or lower and spreading integrally bonded to the engraved outer surface of said base roller to form a substantially uninterrupted film thereover; and (c) an outer microporous ceramic layer bonded to said oleophilic/hydrophobic layer to form the outermost layer of material on said base roller.

2. An ink metering roller as defined in claim 1 wherein said olephilic/hydrophobic material is copper.

3. An ink metering roller as defined in claim 1 wherein said microporous ceramic layer is composed of alumina ($AL_2O_3$).

4. An ink metering roller as defined in claim 1 wherein said oleophilic material is copper and said microporous ceramic layer is composed of alumina ($Al_2O_3$).

5. An ink metering roller as defined in claim 4 wherein said ceramic layer ranges from about 5 to 100 microns in thickness.

6. An ink metering roller as defined in claim 4 wherein said copper layer ranges from about 0.1 to 0.5 mils in thickness.

7. An ink metering roller as defined in claim 4 wherein the alumina is applied in particle form having diameters of from about $0.5\times10^{-4}$ to $5\times10^{-4}$ inch in diameter.

8. An ink metering roller as defined in claim 1 wherein said continuous layer of oleophilic/hydrophobic material has a water contact angle of 90° or higher and an ink contact angle of 10° or lower and spreading.

9. An inking system for use in lithographic printing comprising a plurality of coacting inking rollers, one of said inking rollers being an ink metering roller comprising:

(a) a base roller of suitable diameter and length having an engraved outer surface;

(b) a substantially continuous layer of an oleophilic/-hydrophobic material having a water contact angle or 80° or higher and an ink contact angle of 10° or lower and spreading integrally bonded to the engraved outer surface of said base roller to form a substantially uninterrupted film thereover; and (c) an outer microporous ceramic layer bonded to said oleophilic/hydrophobic layer to form the outermost layer of material on said base roller.

* * * * *